US008210004B2

(12) United States Patent
McMillan

(10) Patent No.: US 8,210,004 B2
(45) Date of Patent: Jul. 3, 2012

(54) ATMOSPHERIC STEAM INJECTION SYSTEM FOR TUNNEL FINISHER

(76) Inventor: Scott Daniel McMillan, Colville, WA (US)

( * ) Notice: Subject to any disclaimer, the term of this patent is extended or adjusted under 35 U.S.C. 154(b) by 250 days.

(21) Appl. No.: 11/641,168

(22) Filed: Dec. 19, 2006

(65) Prior Publication Data

US 2007/0261449 A1 Nov. 15, 2007

Related U.S. Application Data

(60) Provisional application No. 60/798,842, filed on May 9, 2006.

(51) Int. Cl.

| | |
|---|---|
| ***B08B 3/12*** | (2006.01) |
| ***D06B 23/00*** | (2006.01) |
| ***D06F 37/00*** | (2006.01) |

(52) U.S. Cl. ..... 68/5 C; 68/12.23

(58) Field of Classification Search ..... 68/5 C, 68/12.23

See application file for complete search history.

(56) References Cited

U.S. PATENT DOCUMENTS

| | | | | |
|---|---|---|---|---|
| 3,676,057 | A * | 7/1972 | Brown | 8/127.6 |
| 4,304,053 | A * | 12/1981 | Kellerhals et al. | 34/621 |
| 5,516,012 | A * | 5/1996 | Weigel | 223/51 |
| 6,311,526 | B1 * | 11/2001 | Frushtick | 68/5 C |

* cited by examiner

*Primary Examiner* — Michael Barr
*Assistant Examiner* — Jason Ko
(74) *Attorney, Agent, or Firm* — Polsinelli Shughart PC; Richard P. Stitt

(57) ABSTRACT

A tunnel finisher apparatus for use in garment and fabric cleaning and finishing is provided utilizing atmospheric pressure steam to treat the garments or fabrics and using a mixture of highly heated air mixed with atmospheric steam to further treat garments and fabrics.

7 Claims, 1 Drawing Sheet

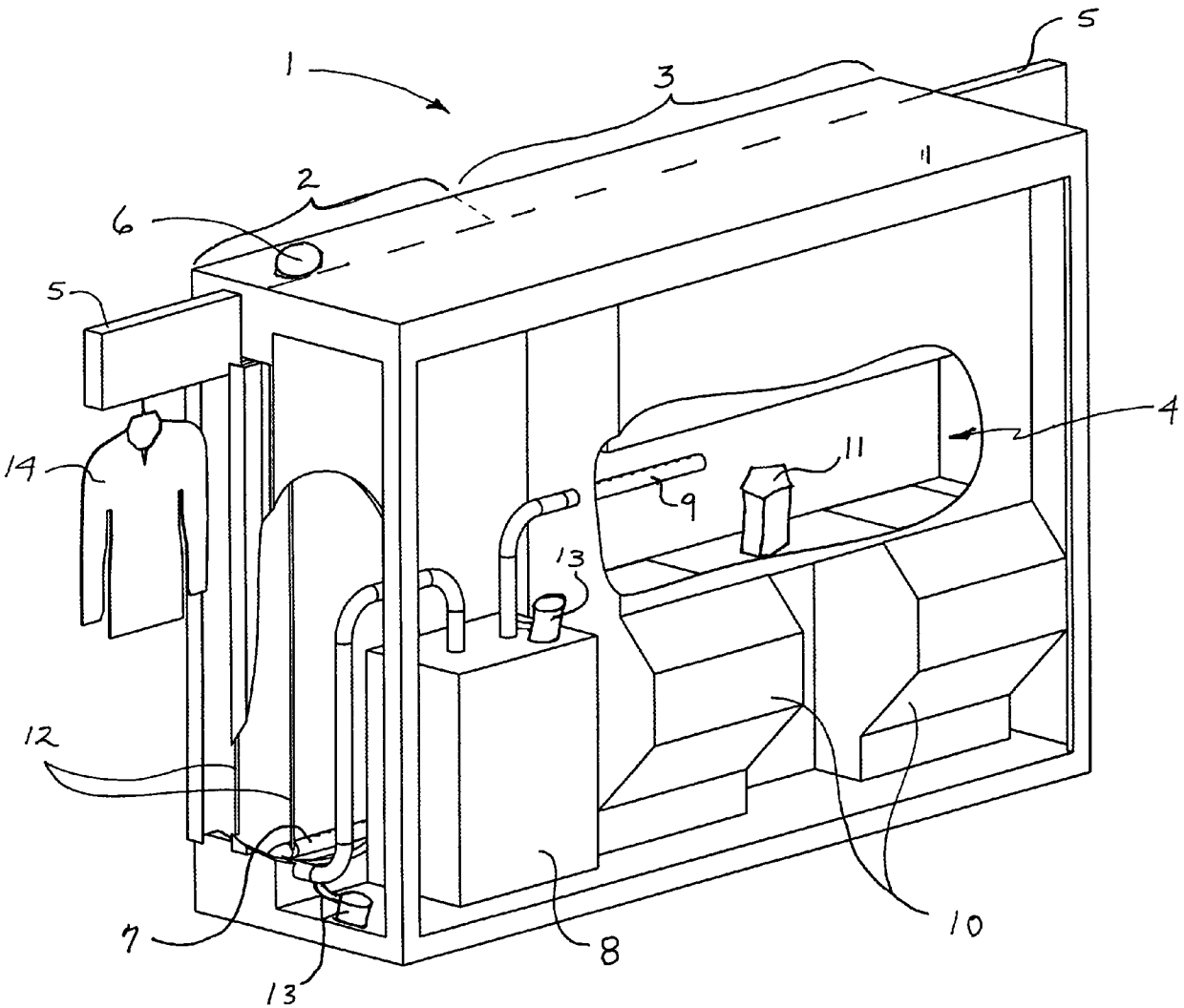
1
2
3
4
5
6
7
8
9
10
11
12
13
14

ATMOSPHERIC STEAM INJECTION SYSTEM FOR TUNNEL FINISHER

CLAIM OF PRIORITY

This application claims priority to provisional application Ser. No. 60/798,842 filed May 9, 2006.

FIELD OF INVENTION

The present invention relates to the delivery of non-pressurized steam or steam at atmospheric pressure to the fabric of garments and other textiles being processed through a tunnel finisher system used in commercial and industrial laundries, in dry cleaning, in the apparel manufacturing and distribution industries and in related industries.

BACKGROUND OF THE INVENTION

The use of steam in tunnel finishers has proven to be effective in de-wrinkling the fabrics of garments and other textile products. The properties of water vapor in the form of steam are excellent for imparting a rise in temperature in the fabric by penetrating the weave and layers of fabric. The moisture content of a fabric aids in the transfer of heat from the air stream to the fabric weave, and also is known to soften cotton fibers. Increasing the temperature of fabric under the presence of moisture in the fabric combined with moisture in the air in the form of steam is essential to the complete de-wrinkling process. Steam is nearly always used for direct injection to the fabric. Steam also may be used for convective air heating and re-heating systems and to re-heat into steam vapor the excess condensate resulting from direct injection steam systems.

Typically, tunnel finishers use pressurized steam from boilers in the pressure range of 40-125 psig (2.8-8.6 bar) with some operating as high as 175 psig (12 bar). The pressurized systems deliver the latent heat of steam plus additional sensible heat due to the higher pressures. This provides ample amounts of heat energy to the textiles. Also, pressurized steam aids in delivering the steam with physical force into the fabric weave thereby achieving penetration of the moisture and heat into the fabric.

While use of high pressure steam is effective in large commercial garment finishing operations where operating a pressurized boiler and steam system is convenient and cost effective, other commercial garment operations have difficulties justifying the high cost, space, technical and regulatory requirements of such pressurized steam systems. In cases in which other laundering processes are not performed on the same site, the only reason to use pressurized steam can be the tunnel finisher itself. Tunnel finishers use live steam, or steam under pressure, for direct injection to the fabric, thus a high degree of steam loss to the surrounding atmosphere is incurred. This loss requires a higher than usual percentage of added feed water to be used in generating the live steam, rather than relying on return condensate which is more economical to re-convert into steam. As a result of this steam loss and the use of live steam a comparatively large boiler system is required for the selected size and scope of the tunnel finisher employed.

A further drawback is that pressurized boilers are subject to certain regulatory requirements that vary widely from country to country, state or province to state or province, county to county, and city to city. This represents an added barrier to the efficient manufacture of tunnel finishers and to their installation. Some jurisdictions regulate boiler operations by placing a limit on the boiler size as measured in boiler horse power (Bhp) before more stringent safety and operational precautions are required by the jurisdiction. For example, for some jurisdictions a boiler of 10 Bhp (approx. 98 kW) or less may not be subject to boiler location and housing safety requirements of the jurisdiction. Other jurisdictions may regulate boiler operations by limiting the boiler to certain delivered steam pressures, for example, a 15 psig (1 bar) on the pressure of the steam generated by the boiler. Additional boiler regulation requirements may be in the form of a requirement for a full time, certified boiler engineer on the premises (a "stationary engineer") or the construction of a specially enclosed room or building to house the boiler. These variations in the regulation of high pressure boilers create a difficult maize a manufacturer and/or user of high pressure steam tunnel finishers to traverse. Also, the regulations on use of high pressure boilers present a substantial added cost and complication to the operation of smaller commercial laundry and garment finishing concerns.

Typical tunnel finisher systems are designed to use piping and steam spray holes, slits, or nozzles which function well at pressures over 40 psig (2.8 bar). These systems have only marginal effectiveness at steam pressures of 15-40 psig (1-2.8 bar), and minimal or poor effectiveness at steam pressures below 15 psig (1 bar). Moreover, the potential energy available for convective air heating (heat exchangers) and reheating condensate into steam becomes less than effective below 15 psig (1 bar). At low steam pressures, conventional tunnel finisher devices cannot, in a reasonable amount of time, deliver enough heat energy to the fabric for de-wrinkling and/or moisture removal for good performance. Even for very small tunnel finishers, typical steam requirements total at least 10 Bhp (approx. 98 kW), and still suffer from the previously mentioned high make-up water requirements.

Due to onerous regulatory requirements and the high cost and complexity of pressurized boiler systems over 10 Bhp (approx. 98 kW) in size, use of a tunnel finisher becomes a difficult process to implement for those businesses and operations that do not otherwise have access to a boiler. Presently, if low-pressure steam systems are employed, the performance of the tunnel finisher will suffer, and the excess condensate tends to drain along the floor of the finisher, creating a hygiene and corrosion problem. If low pressure boilers are employed in conventional tunnel finishing devices, the boiler may not be able to heat the necessary make-up water rapidly enough, causing "boiler carry over." "Boiler carry over" is a situation in which liquid water and water treatment chemicals are pushed through the piping systems into the injection tubes of the tunnel finisher, creating unsightly "brown spots" on the fabric and walls of the finisher, as well as excess water in the system.

Previous attempts to solve these issues were limited in effectiveness. The "Hydro Finisher" developed by Colmac Industries, Inc., in 1988 attempted to boil water directly in a chamber of the tunnel finisher by spraying water directly on a heat source. The desired finishing effect was excellent, however the machine was not able to sufficiently control the excess water and distillates to avoid self-corrosion. The "Hydro Tech" developed by Colmac Industries, Inc., in 1997 attempted to mix water into heated air to deliver super heated air/water vapor to the fabric. In this device the distillates were an issue and the effectiveness of flashing the water droplets to steam with heated air was impractical due to the high energy requirements.

Other prior art systems have attempted to use low pressure steam delivered through small, typically copper or stainless steel, tubes of less than ¾" (19 mm) diameter to deliver steam to the fabric of the textiles being finished. These devices relied on the motive force of the pressure of the steam to deliver the steam into the fabric weave. However, as steam pressure decreased, the steam failed to sufficiently penetrate the fabric weave, and performance of these devices suffered. Other prior art systems have tried to mix water directly in the heating mixing chambers. But the amount of energy diluted from the air heating system to overcome the latent heat of evaporation to convert the water to steam reduced the air heating to ineffective levels.

Therefore, it would be a benefit if a low pressure tunnel finisher were developed which could avoid the regulatory requirements of high pressure steam boilers while providing effective and efficient low pressure steam generation that avoided "boiler carry over" and excess condensation within the tunnel finisher device.

SUMMARY OF THE INVENTION

The present invention provides a means of mixing atmospheric pressure steam with the recirculating air systems in a tunnel finisher to create a high temperature, high humidity air stream which delivers heat energy, in the presence of moisture-laden air, to garments and textiles.

The present invention delivers steam to the process chambers of the tunnel finisher by means of an atmospheric pressure steam generation system. Such systems are not regulated by states and other jurisdictions, to the degree pressurized boiler systems may be, and avoid the requirement of having a on-site boiler engineer and the special housing construction requirements sometimes applied to high pressure steam boilers.

The present invention achieves steam penetration into textile fabrics and provides high heat transfer effects to accomplish garment finishing without the excess condensate and low temperature performance issues associated with previous low pressure steam or low powered boiler system designs of tunnel finishers.

The present invention avoids the high cost and high complexity of the installation of high pressure boilers, make-up water systems, piping, traps, filters for the sole purpose of enabling a tunnel finisher operation. The present invention does not require the water treatment chemical costs and regular daily operational and safety procedures required to operate a high pressure or pressurized steam system.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention.

DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims FIG. 1 is a perspective view of a shoulder-to-shoulder tunnel finisher 1 showing steam dispersion tubes 9 mounted inside a heating/mixing chamber 4, in which air is mixed with steam and further heated, then delivered to the textile process zone of the finishing chamber 3, which then returns to the heating mixing chamber 4 for recirculation and showing steam dispersion tubes 7 mounted inside pre-conditioning chamber 2 in which passively heated air and steam from dispersion tube 7 and steam exhaust from finishing chamber 3 contact textiles or garments 14 as the passively heated air and steam from dispersion tube 7 and steam exhaust from finishing chamber 3 is drawn upward through pre-conditioning chamber 2 by exhaust fan 6.

DETAILED DESCRIPTION

As required, detailed embodiments of the present inventions are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The present invention uses an atmospheric pressure steam humidifier 8 to deliver high temperature, highly moisture-laden air to garments or textiles 14 within a recirculating air chamber or finishing chamber 3 in a tunnel finisher 1. A suitable steam generation unit 8 can be obtained from Armstrong International in the form of the Armstrong Humidiclean Model HC4500. This device provides 144 lb/hr (65 Kg/hr) of steam at atmospheric pressure, using tap water input and an ionic bed water purifier to remove impurities thereby enabling tap water use in the system. The steam outlet is by way of two (2) approximately 2⅜" diameter tubes. It will be appreciated that larger and smaller sized tubes may be used.

As previously stated one important benefit of the present invention is the delivery of atmospheric pressure steam (which can only be heated, by definition, to a maximum of 212° F. (100° C.)) to the fabric or garment 14 at higher temperatures such as a temperature between 240° F. to 320° F. (116° C. to 160° C.). This is accomplished by employing a means of mixing the atmospheric pressure steam from steam generator 8 with additional, highly heated, air that is heated above the 212° F. (100° C.) temperature of the atmospheric pressure generated steam. In the present invention the highly heated air is at a temperature between 240° F. to 320° F. (116° C. to 160° C.).

Heating element 11 for producing the highly heated air can be a natural gas heater, direct fired or indirect fired, or an electric heating device. While a steam heater could be used, it is ideally to be avoided as exclusion of high pressure steam from the present invention is a principle benefit of the present invention. However, tests performed using a pressurized steam-coil to heat the air worked well. Electric heating elements suitable for use are formed tubular elements manufactured by Incoloy Watlow. One embodiment of the present invention included twenty-seven (27) heating elements of 4 kW each to provide 108 kW of heating. Larger heating elements of 25-300 kW may be employed depending on the size and desired capacity of the tunnel finisher.

The mixing of the high temperature air and steam takes place in a heating/mixing chamber 4 and is accomplished prior to the steam/heated air mixture being supplied to the finishing chamber 3. It is essential to accomplish the garment or fabric 14 temperature increase in the presence of moisture, the moisture being present in both the garment or fabric 14 and in the atmosphere of the finishing chamber 3 to thereby enhance and complete the garment or fabric 14 dewrinkling process. The transfer of the steam from steam generator 8 into the heating/mixing chamber 4 is accomplished by dispersion tube 9. Dispersion tube 9 generally is one inch to three inches in diameter and is provided with holes of approximately one-half inch diameter to allow the generated atmospheric pressure steam to be released into heating/mixing chamber 4. Alternatively, heating/mixing chamber 4 may be provided with an open pipe of one inch to three inches in diameter. Dispersion tubes 7, 9 may be of any suitable metal—thick black steel pipe or thin-wall stainless etc. It will be appreciated that In some embodiments the dispersion tubes can be eliminated.

Another important aspect of the present invention is pre-conditioning chamber 2 in which moderately heated air and steam are allowed to mix at temperatures generally less than 212° F. (100° C.). This exposure of the garment or fabric 14 to a moderately heated air and steam combination provides moisture content to the garment 14 just prior to entry into the finishing chamber 3 and preserves the initial fabric moisture content for a sufficient time to delay drying and to keep the garment 14 moist during the exposure to the higher temperature air and steam mixture of the finishing chamber 3 to thereby more completely perform dewrinkling.

Referring to FIG. 1 a tunnel finisher 1, oriented in the shoulder-to-shoulder configuration having pre-conditioning chamber 2, a finishing process chamber 3, and heating/mixing chamber 4 is shown. Garments or other textiles 14 enter the finisher 1 on conveyor system 5, and are first processed in pre-conditioning chamber 2. In pre-conditioning chamber 2, steam is provided by means of dispersion tube 7. Dispersion tube 7 generally is one inch to three inches in diameter and is provided with holes of approximately one-half inch diameter to allow the generated atmospheric pressure steam to be released into pre-conditioning chamber 2. Dispersion tube 7 may be of any suitable metal—thick black steel pipe or thin-wall stainless etc.

In pre-conditioning chamber 2, steam from dispersion tube 7 rises throughout pre-conditioning chamber 2, across textiles 14, and exits chamber 2 through exhaust 6. Additional moisture laden air is drawn into pre-conditioning chamber 2 from the lower part of the finishing chamber 3, and also is pulled across the textiles 14 and to exhaust vent 6. Steam for pre-conditioning chamber 2 is generated in the steam generator 8 or may be generated by a separate steam generator. The generated steam is delivered to pre-conditioning chamber 2 by dispersion tubes 7.

Air from finishing chamber 3 is recirculated by forcing the now somewhat cooled mixed high heat air and steam into heating/mixing chamber 4 by use of one or more blowers 10. Additional heat then is delivered to the heating/mixing chamber via a heating element 11, which may be gas fired, electric, or other means as described above.

In an alternative embodiment of the invention, water spray tubes 12 may be included in pre-conditioning chamber 2 and/or in finishing chamber 3 of tunnel finisher 1. In this embodiment, warm water is sprayed lightly onto garment 14 with spray nozzles. This adds moisture to the fabric more thoroughly than with the steam/air mixtures of pre-conditioning chamber 2 and/or to finishing chamber 3 alone. In this embodiment is has been found that heat transfer and wrinkle removal is visibly improved in the case of dry inbound textiles 14 than with steam/air mixture alone.

In yet another embodiment of the invention, the water spray tubes 12 can deliver additional chemical agents to the fabric. These agents may be enhanced de-wrinkling agents, de-odorization agents, garment hygiene agents (bacteria removal or disinfection), and smoke residue removal agents. Alternatively, these additional chemical agents can be added to the feed water of the water spray tubes of pre-conditioning chamber 2. A certain amount of the chemical is then delivered along with the steam to the fabric via the mixing chamber and recirculating air system.

In another embodiment of the invention, the chemical agents can be added through use of the dispersion tubes 7,9. A water/chemical mixture is stored in reservoir/injector mechanism 13. The chemically treated water is injected into the heating/mixing chamber 4 and/or finishing chamber 3 along with the atmospheric steam via dispersion tubes 7,9. The chemically treated water is instantly vaporized and allowed to mix with the steam and air and fabric to achieve the desired fabric deodorization and/or fabric dewrinkling and/or fabric anti-bacterial and/or fabric softening effects.

Odor removal is typically achieved by chemical additives in dry cleaning machines, chemical additives to the wash chemicals, or ozone fumigation rooms. Each process is partially effective, but may require multiple cleanings or multiple methods. The use of the invention adds another odor removing step in the sunk cost of the finishing process, combining an additional odor removing process. This may eliminate one of the otherwise additional steps required. For other odor removing applications, such as returned catalog sale clothing or thrift stores, simply using the tunnel finisher based odor removing step could achieve the odor removal and refinishing in one step, eliminating the need to dry clean or wet wash.

Smoke residue removal is typically achieved by chemical additives in dry cleaning machines, chemical additives to the wash chemicals, or ozone fumigation rooms. Each process is partially effective, but may require multiple cleanings or multiple methods. The use of the invention adds another odor removing step in the sunk cost of the finishing process, combining an additional odor removing process. This may eliminate one of the otherwise additional steps required.

From the foregoing it will be appreciated that, although specific embodiments of the invention have been described herein for purposes of illustration, various modifications may be made without deviating from the spirit and scope of the invention. For example, the orientation of the tunnel finisher may be different from that described above. The tunnel may be constructed in different path forms (U-shape, L-shape, corners, S- or C-sections) and also in different garment orientations (shoulder to shoulder, wide-body). Furthermore, in some designs, the order of chambers may vary from pre-conditioning, finishing, cool down, multiple repeating finishing chambers, alternating pre-conditioning, steaming, wetting, and finishing chambers, etc. Accordingly, the invention is not limited except as by the appended claims.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

Having now described the features, discoveries and principles of the invention, the manner in which the inventive tunnel finisher for processing garments are constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

The invention claimed is:

1. A tunnel finisher for fabric garments comprising:

a housing, a preconditioning chamber in said housing for receiving atmospheric steam therein to moisten the fabric of the garments, a finishing chamber in said housing connected to said preconditioning chamber to provide in said finishing chamber contact between garments and an injected mixture comprising highly heated atmospheric steam and highly heated air, a heater for heating air to a temperature of between 240° F. to 320° F. (116° (3 to 160° (3) to provide a source of highly heated air, an isolated heating/mixing chamber formed in said housing by walls to isolate said heating/mixing chamber from said finishing chamber and from the garments, said heating/mixing chamber having said highly heated air delivered thereto and atmospheric pressure steam delivered thereto for mixing the atmospheric steam with said highly heated air within said isolated heating/mixing chamber to produce highly heated atmospheric steam having a temperature above 212° F. (100° (3) prior to introduction of said highly heated atmospheric steam into said finishing chamber, a blower connected to said heating/mixing chamber to mix within said heating/mixing chamber said atmospheric steam with said highly heated air said blower injecting said mixture comprising highly heated atmospheric steam and highly heated air into a finishing chamber, a generally atmospheric pressure steam generator to provide steam at a generally atmospheric pressure, a dispersion tube connecting said steam generator to said preconditioning chamber and to said heating/mixing chamber said tube having a plurality of voids therein for distributing steam from said steam generator in said preconditioning chamber and in said heating/mixing chamber, and a track traveling through said housing to carry the garments first through said preconditioning chamber and then through said finishing chamber.

2. The apparatus as claimed in claim 1 further comprising a water spray tube in said finishing chamber and/or in said preconditioning chamber.

3. The apparatus as claimed in claim 1 further comprising an exhaust vent connected to said preconditioning chamber to draw said steam across the garments within said preconditioning chamber.

4. The apparatus as claimed in claim 1 further comprising a second blower to move said mixture from said finishing chamber and into said heating/mixing chamber for combining said mixture with said highly heated air and said atmospheric steam.

5. A tunnel finisher for fabric garments comprising:

a housing, a heater for heating air to a temperature of between 240° F. to 320° F. (116° C. to 160° C.) to provide a source of highly heated air, an isolated heating/mixing chamber formed in said housing by walls to isolate said heating/mixing chamber from a finishing chamber and from the garments, said heating/mixing chamber receiving a supply of atmospheric steam and said highly heated air for mixing of said atmospheric steam with said highly heated air within said heating/mixing chamber to heat said atmospheric steam to a temperature above 212° F. (100° C.), to produce a highly heated atmospheric steam and highly heated air mixture prior to introduction of the mixture into said finishing chamber, a blower connected to said heating/mixing chamber for mixing to mix within said heating/mixing chamber said atmospheric steam with said highly heated air said blower injecting said mixture comprising highly heated atmospheric steam and highly heated air into said finishing chamber, a generally atmospheric pressure steam generator to provide steam at a generally atmospheric pressure to said heating/mixing chamber, said finishing chamber in said housing to provide a chamber for contact of said mixture of highly heated atmospheric steam and highly heated air with the garments, a dispersion tube connecting said steam generator to said heating/mixing chamber said tube having a plurality of voids therein for distributing steam from said steam generator in said heating/mixing chamber, and a track traveling through said housing to carry the garments through said finishing chamber.

6. The apparatus as claimed in claim 5 further comprising a water spray tube in said finishing chamber.

7. The apparatus as claimed in claim 5 further comprising a second blower to move said mixture from said finishing chamber and into said heating/mixing chamber for combining said mixture with said highly heated air and said atmospheric steam.

* * * * *